US005357318A

United States Patent [19]

Haneda et al.

[11] Patent Number: 5,357,318

[45] Date of Patent: Oct. 18, 1994

[54] COLOR IMAGE FORMING APPARATUS WITH INTERCHANGEABLE CHARGING AND TRANSFERRING DEVICES

[75] Inventors: Satoshi Haneda; Masakazu Fukuchi, both of Hachioji; Shizuo Morita, Tachikawa, all of Japan

[73] Assignee: Konica Corporation, Tokyo, Japan

[21] Appl. No.: 60,504

[22] Filed: May 12, 1993

Related U.S. Application Data

[63] Continuation of Ser. No. 892,743, Jun. 4, 1992, abandoned.

[30] Foreign Application Priority Data

Aug. 19, 1991 [JP] Japan ..... 3-206882
Aug. 30, 1991 [JP] Japan ..... 3-220336

[51] Int. Cl.[5] ..... G03G 15/00; G03G 15/02; G03G 15/16

[52] U.S. Cl. ..... 355/210; 355/221; 355/274

[58] Field of Search ..... 355/200, 212, 219, 221, 355/270, 274, 326, 327

[56] References Cited

U.S. PATENT DOCUMENTS 4,901,110 2/1990 Tompkins et al. ..... 355/212
5,065,195 11/1991 Haneda et al. ..... 355/326 X
5,142,327 8/1992 Kahle ..... 355/212
5,155,526 10/1992 Kawabata ..... 355/212

FOREIGN PATENT DOCUMENTS 61-167968 7/1986 Japan ..... 355/212
61-151560 10/1986 Japan .
61-282863 12/1986 Japan ..... 355/219

*Primary Examiner*—Joan H. Pendegrass
*Attorney, Agent, or Firm*—Finnegan, Henderson, Farabow, Garrett & Dunner

[57] ABSTRACT

In a color image forming machine including a belt-shaped photoreceptor stretched around a plurality of rollers, and a horizontal portion of the photoreceptor being disposed above and in parallel to face a plurality of developing devices, a charging device and a transfer device are disposed to face the photoreceptor at a common position where the photoreceptor is curved around one roller. A cleaning device is disposed to face the photoreceptor at a position where the photoreceptor is curved around the other roller. The charging device is used as a transfer device by changing supplied voltage or is interchangeable with the transfer device by being either slid or rotated between two positions. The photoreceptor, the developing devices and the cleaning device are integrally formed as a cartridge which is detachably mountable to the machine. The photoreceptor is rotated at least five times when a color image is formed by the processes of charging, exposing, transferring and cleaning, and is rotated at least twice when a monochromatic image is formed by the processes.

4 Claims, 7 Drawing Sheets

COLOR IMAGE FORMING APPARATUS WITH INTERCHANGEABLE CHARGING AND TRANSFERRING DEVICES

This application is a continuation of application Ser. No. 07/892,743 filed Jun. 4, 1992, now abandoned.

BACKGROUND OF THE INVENTION

The present invention relates to a color image forming apparatus in which a color image is formed on a photoreceptor belt by means of electrophotography and the formed color image is transferred onto a transfer sheet.

A conventional color image forming apparatus in which a photoreceptor belt is provided approximately horizontally and a plurality of developing units are disposed below the lower surface of the photoreceptor belt, is disclosed, for example, by the Japanese Patent Application Open to Public Inspection No. 151560/1986. The color image forming apparatus in the prior art is widely known. According to the color image forming apparatus, the photoreceptor belt is disposed approximately horizontally, and a plurality of developing units are disposed in parallel below the lower surface of the photoreceptor belt while the openings of the developing units are directed upward. There are provided two rotating rollers which are opposed to each other, and the photoreceptor belt is wrapped around the rollers. Around the photoreceptor belt, there are provided; a charger; an exposure unit of a laser writing system; developing units which accommodates developers of yellow, magenta, cyan and black; a transfer unit which is disposed in such a manner that the transfer unit faces a curved portion of the photoreceptor belt wrapped around one rotating roller, wherein a predetermined gap is formed between the transfer unit and the photoreceptor belt; and a fixing unit disposed in an upper location of the transfer unit. Further, there is provided a cleaning unit which is disposed in such a manner that the cleaning unit faces a curved portion of the photoreceptor belt wrapped around the other rotating roller, wherein a predetermined gap is formed between the cleaning unit and the photoreceptor belt.

The color image forming apparatus with this arrangement consecutively records color images on recording papers which are conveyed intermittently.

In a practical color printer or a color copier, color toner remaining on the surface of a photoreceptor belt is removed with a cleaning unit. After a number of cleaning operations, the charger disposed adjacent to the cleaning unit and the surfaces of a lens and a mirror of the laser writing unit become stained with scattered toner, so that the quality of toner images formed the surface of a photoreceptor belt or a recording paper is affected by the scattered toner.

In the case of a color image forming apparatus in which the charger and the transfer unit are disposed at different end portions of the photoreceptor belt with regard to its longitudinal direction, the dimensions of the image forming apparatus are necessarily increased.

SUMMARY OF THE INVENTION

It is a primary object of the present invention to provide a color image forming apparatus in which the charger and the optical system of the laser writing unit are not stained by scattered toner, and the dimensions of the apparatus are reduced.

According to the first structure of the color image forming apparatus of the present invention, a photoreceptor belt and a plurality of developing units are disposed in parallel, and a cleaning unit is disposed next to the aforementioned developing units, as well as a charging means which are either common or interchangeable.

The second structure of the color image forming apparatus of the present invention comprises either the following item (a) or (b).

(a) A photoreceptor belt and a plurality of developing units are disposed in parallel, and a cleaning unit is disposed next to the aforementioned developing units. The photoreceptor belt and developing units are integrally attached to and detached from the image forming apparatus.

(b) When a color image is formed through the color image forming process according to item (a) including charging, exposing, developing, transferring and cleaning, the photoreceptor belt is rotated 5 times, and when a monochromatic image is formed, the photoreceptor belt is rotated twice.

DETAILED DESCRIPTION OF THE PREFERRED EMBODIMENT

Figure 1:
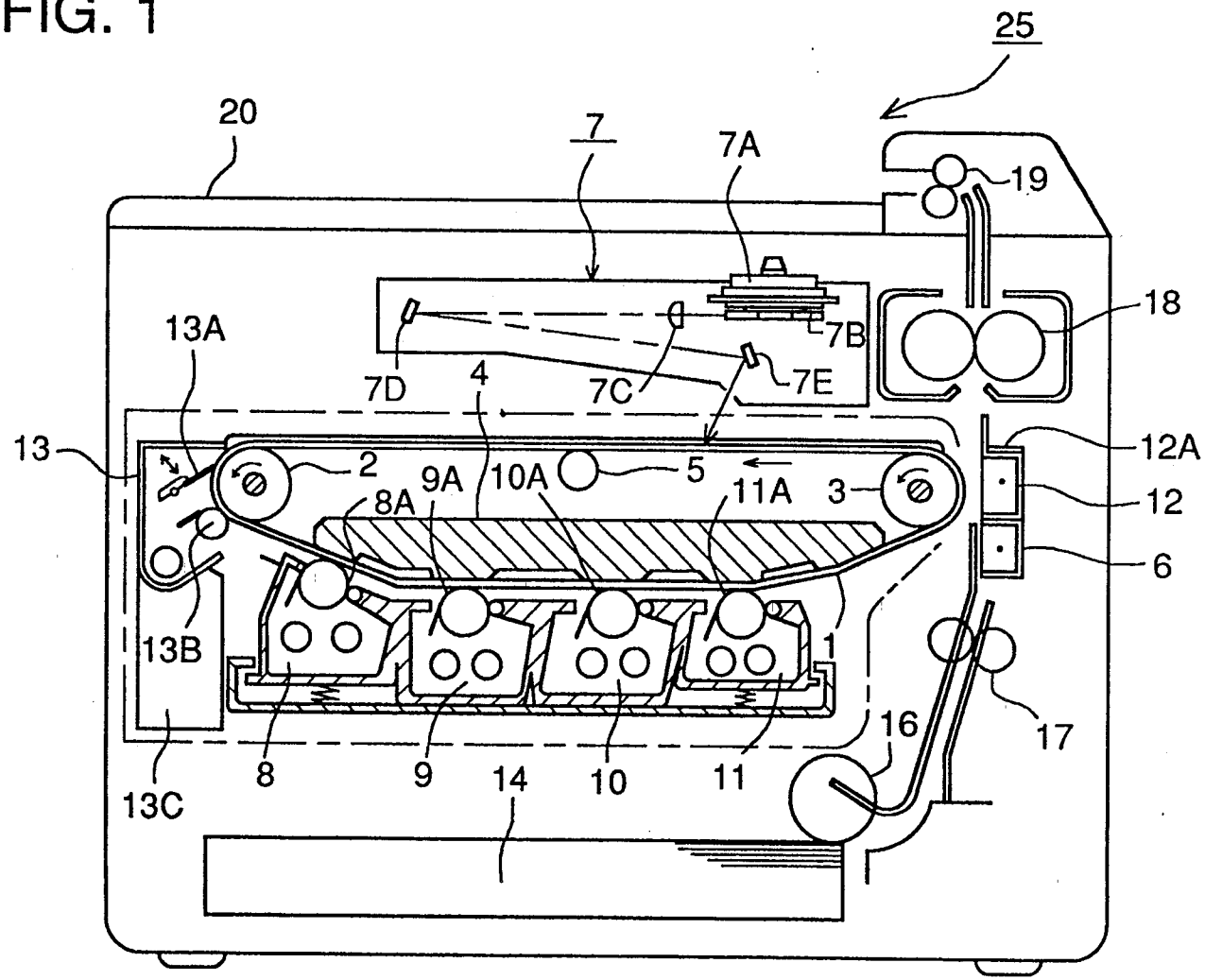
FIG. 1 is a sectional side view showing the structure of the color image forming apparatus of the first example of the present invention.

In FIG. 1, numeral 1 is a flexible photoreceptor belt, which is provided between rotating rollers 2 and 3, and when driven by the rotating roller 2, it is rotated counterclockwise as shown by an arrow mark in the drawing.

Numeral 4 is a guide member which is fixed to the apparatus body and by which the photoreceptor belt 1 is guided. When tension is applied to the photoreceptor belt 1 by the action of a tension roller 5, the photoreceptor belt 1 becomes tight, so that the inner circumferential surface of the photoreceptor belt 1 slidably comes into contact with the guide member 4. Recesses are formed in the portions of the guide member 4 which are not necessary for image formation so that the frictional resistance can be reduced. When the frictional resistance is not so high, it is not necessary to provide these recesses. For the purpose of reducing the frictional resistance caused between the photoreceptor belt 1 and the guide member 4, it is preferable to provide a low frictional material such as Teflon onto the surface of either the photoreceptor belt 1 or the guide member 4.

Either the photoreceptor belt 1 or the guide member 4 may be made of the low frictional material.

Therefore, the photoreceptor provided on the photoreceptor belt 1 always maintains a constant positional relationship with regard to the surface of the guide member 4. Accordingly, a stable image forming surface can be formed.

When the developing and cleaning units are disposed below the photoreceptor belt, the scatter and spill of developer can be prevented.

Numeral 6 is a scorotron charger which is a charging means, numeral 7 is a laser writing system unit which is an exposure means, and numerals 8 to 11 are a plurality of developing units which accommodate developers of specific colors. These image forming means are disposed so that they are opposed to the photoreceptor belt 1 which is slidably contacted with the guide member 4. In order to allow the photoreceptor belt to rotate smoothly, a gap maintaining means is provided to the guide member 4 so that an appropriate gap can be maintained between the photoreceptor belt 1 and these image forming means.

The optical system shown in the drawing is adopted for the laser writing system unit, and further an optical system in which a light emitting section and a convergent type of light transmission member are integrally provided.

The developing units 8, 9, 10, 11 accommodate, for example, yellow, magenta, cyan and black toners. The developing units are provided with developing sleeves 8A, 9A, 10A, 11A which are disposed in such a manner that a predetermined gap is maintained between the developing sleeves and the photoreceptor belt 1. Accordingly, a latent image formed on the photoreceptor belt can be developed into a visual image by means of non-contact development. This non-contact developing method is different from a contact developing method. According to the non-contact developing method, rotating motion of the photoreceptor belt 1 is not obstructed.

Numeral 12 is a transfer unit, which is disposed above the charger 6 and slid vertically together with the charger 6 so that the set position can be changed over. Numeral 12A is a neutralizing plate. Numeral 13 is a cleaning unit, and a blade 13A of the cleaning unit 13 and a toner conveyance roller 13B are separated from the surface of the photoreceptor belt 1, and when a cleaning operation is carried out after image transfer, they are contacted with the surface of the photoreceptor belt 1 with pressure.

In the color image forming apparatus 25, color image forming is carried out as follows.

Figure 2:
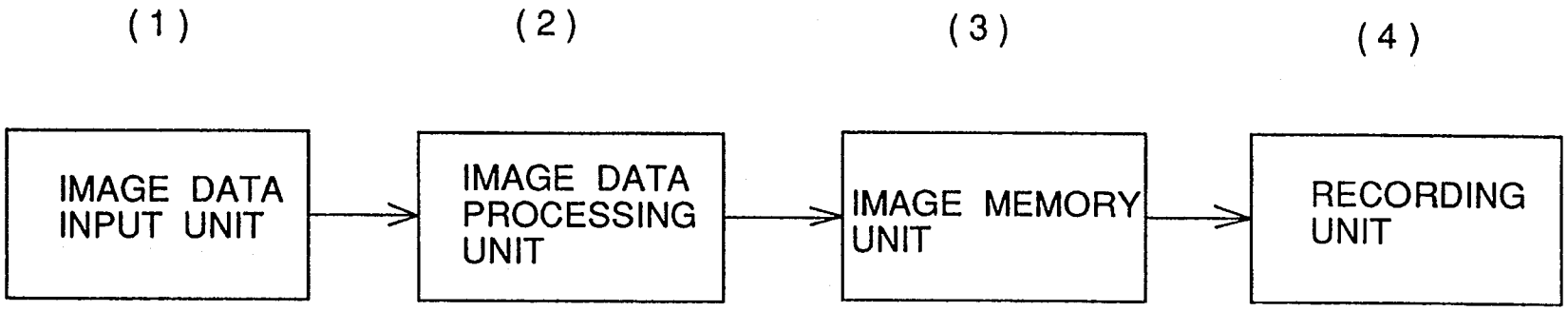
FIG. 2 is a block diagram showing the image forming process of the present invention.

Multi-color image formation of this example is carried out according to the image forming system shown in FIG. 2. In a color image data input unit (1) shown in FIG. 2, an image sensor scans an original image, and the obtained data is calculated by an image data processing unit (2). The obtained image data is temporarily stored in an image memory (3). The stored image data is taken out from the memory in the process of recording and inputted into a recording section (4), for example, the color image forming apparatus 25 shown in FIG. 1.

A color signal outputted from an image reading apparatus which is different from the printer, is inputted into the laser writing system unit 7. In the laser writing system unit 7, a polygonal mirror 7B is rotated so that rotary scanning is carried out by laser beams generated in a semiconductor laser unit (not shown). The laser beams pass through an $f\theta$ lens 7C, and the optical path of the laser beams is curved by mirrors 7D and 7E. Then, the laser beams are projected on the circumferential surface of the photoreceptor belt 1 onto which an electrical charge is given by the charger 6.

On the other hand, when the aforementioned scanning operation is started, the laser beams are detected by an index sensor, and beam modulation according to the first color signal is started. The modulated laser beams scan the circumferential surface of the photoreceptor belt 1. Accordingly, a latent image corresponding to the first color is formed on the circumferential surface of the photoreceptor belt 1 with the primary scanning conducted by the laser beams and the auxiliary scanning conducted by photoreceptor belt conveyance. This latent image is subjected to reversal development conducted by the developing unit 8 loaded with yellow (Y) toner under the condition of non-contact, so that a toner image is formed on the surface of the photoreceptor belt. While the formed toner image is held on the belt surface, the belt passes under the cleaning unit 13 which is separated from the circumferential surface of the photoreceptor belt, and the next copy cycle is started.

Then, the photoreceptor belt 1 is charged again by the charger 6, and the second color signal outputted from the signal processing section is inputted into the laser writing system unit 7 so that a latent image is formed on the belt surface in the same manner as the first color signal. This latent image is subjected to reversal development conducted by the developing unit 9 loaded with magenta (M) toner under the condition of non-contact.

This magenta (M) toner image is formed on the yellow (Y) toner image which has already been formed on the surface of the photoreceptor belt.

Numeral 10 is a developing unit loaded with toner of cyan (C). This developing unit 10 forms a toner image of cyan (C) on the belt surface in accordance with a control signal generated in the signal processing section.

Numeral 11 is a developing unit loaded with toner of black. This developing unit 11 forms a toner image of black on the belt surface in the same manner as mentioned before. A DC or AC bias is applied upon the sleeves of the developing units 8, 9, 10 and 11, and the latent image is subjected to jumping development of one or two-component developer. Since the apparatus body is grounded, non-contact development is conducted on the photoreceptor belt 1.

The color toner image formed on the circumferential surface of the photoreceptor 1 is transferred onto a transfer sheet sent from a paper feed cassette 14 through a paper feed guide 15, with the transfer unit 12 and the neutralizing plate 12A.

The uppermost transfer sheet on the paper feed cassette 14 is conveyed out when a paper feed roller 16 is rotated. Then, the transfer sheet is supplied to the transfer unit 12 through a timing roller 17 in synchronization with the image formation on the photoreceptor belt 1.

Since the electrical charge has been removed from the transfer sheet onto which the color image has been transferred, toner is not scattered, so that the image quality is not deteriorated. The moving direction of this transfer sheet is sharply changed when it is conveyed along the rotating roller 2, so that the transfer sheet is positively separated from the photoreceptor belt, and conveyed upward. After the toner image on the transfer sheet has been fixed by the fixing roller 18, the transfer sheet is discharged onto a tray 20 through a paper discharge roller 19.

After the transfer operation has been completed, the photoreceptor belt 1 is further rotated, and the blade 13A and the toner conveyance roller 13B are contacted with the photoreceptor belt 1 with pressure so that the residual toner on the belt surface can be removed. After the cleaning operation has been completed, the blade 13A is separated from the belt surface again, and a little after that, the toner conveyance roller 13B is also separated, and a new image forming process is started.

Figure 6:
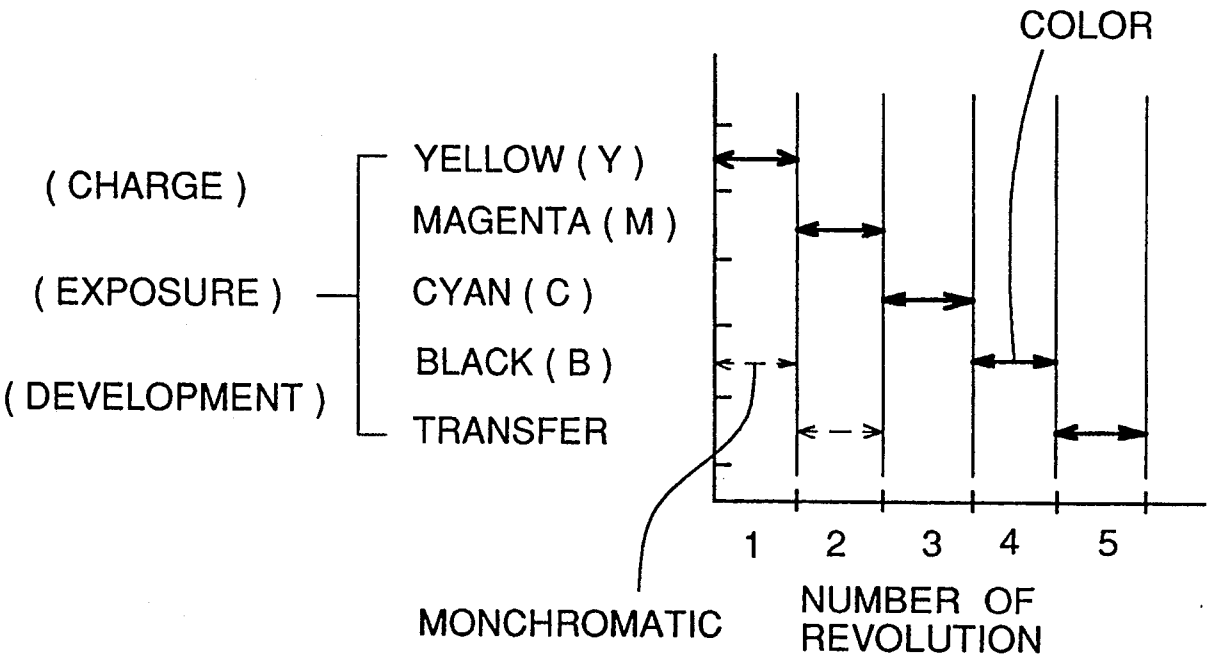
FIG. 6 is a schematic illustration showing the numbers of rotation when color and monochromatic images are formed in the first example of the present invention.

The relation between each process of charging, exposure, development and transfer, and the rotation of the photoreceptor belt 1, is shown by a solid line in FIG. 6. As shown in the drawing, in the first revolution, an electrostatic latent image formed on the surface of the photoreceptor belt 1 through the process of scorotron charging and exposure, is developed with yellow toner.

In the second revolution, charging , exposure and development with magenta toner are conducted on a latent image. In the same manner as described above, in the third revolution, development is conducted with cyan toner, and in the fourth revolution, development is conducted with black toner. Accordingly, while the photoreceptor belt 1 is rotated by 4 revolutions, a color image including yellow, magenta, cyan and black toners is formed. In order to stably and excellently transfer the color image formed on the photoreceptor belt 1 onto a transfer sheet, the photoreceptor belt 1 having the toner image on its surface is further rotated by one revolution, and the toner image is transferred on the transfer sheet with the transfer unit 12 which has been changed over to a position shown in FIG. 1. After that, the photoreceptor belt 1 is cleaned by the cleaning unit 13. That is, the photoreceptor belt 1 is rotated 5 revolutions in total from the first charging operation to the cleaning operation. Consequently, when the toner image is transferred, the developing process has already been completed. Therefore, the toner image can be stably transferred. Further, when a thick paper or a thick transparent sheet is utilized, or when a monochromatic image is formed, image forming conditions such as a photoreceptor belt speed, and fixing and transfer conditions are appropriately changed, so that image formation can be effectively carried out. The relation between the image forming process and the rotation of the photoreceptor belt 1 in the case where a monochromatic image is formed, is shown by a dotted line in FIG. 6. Charging and exposure are carried out at the first rotation of the photoreceptor belt so that an electrostatic latent image is formed on the photoreceptor belt surface. Black toner is given to the electrostatic latent image for development.

In the same manner as the aforementioned case in which a color image is formed, the photoreceptor belt 1 is rotated by one revolution while it holds a color image on its surface. After that, the toner image is transferred onto a transfer sheet with the transfer unit 12 disposed in a position shown in FIG. 1, and then a cleaning operation is conducted on the photoreceptor belt 1.

That is, when the photoreceptor belt 1 is rotated by two revolutions in the case of monochromatic image formation, the same effect as that in the case of color image formation, can be provided.

Figure 3:
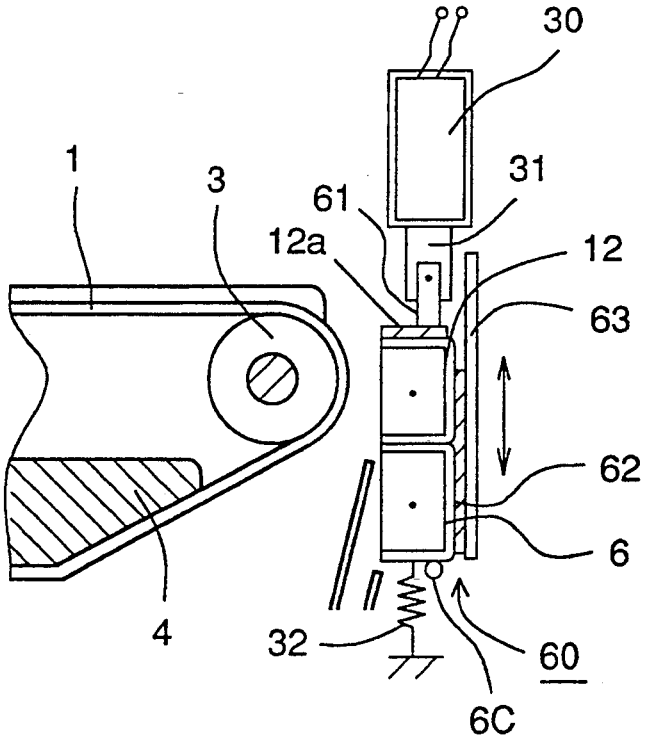
FIG. 3 is a side view showing the structure of the charging and transferring units of the first example of the present invention.

Next, with reference to FIGS. 3 and 4, the changeover operation between the charger 6 and the transfer unit 12 will be explained as follows.

An integrating member 60 holds the transfer unit 12 having the neutralizing plate 12A, and the charger 6. The integrating member 60 is pulled downward by a spring 32, one end of which is fixed to the frame of the image forming apparatus 25, so that the integrating member 60 is positioned by a stopper 6C.

Figure 4:
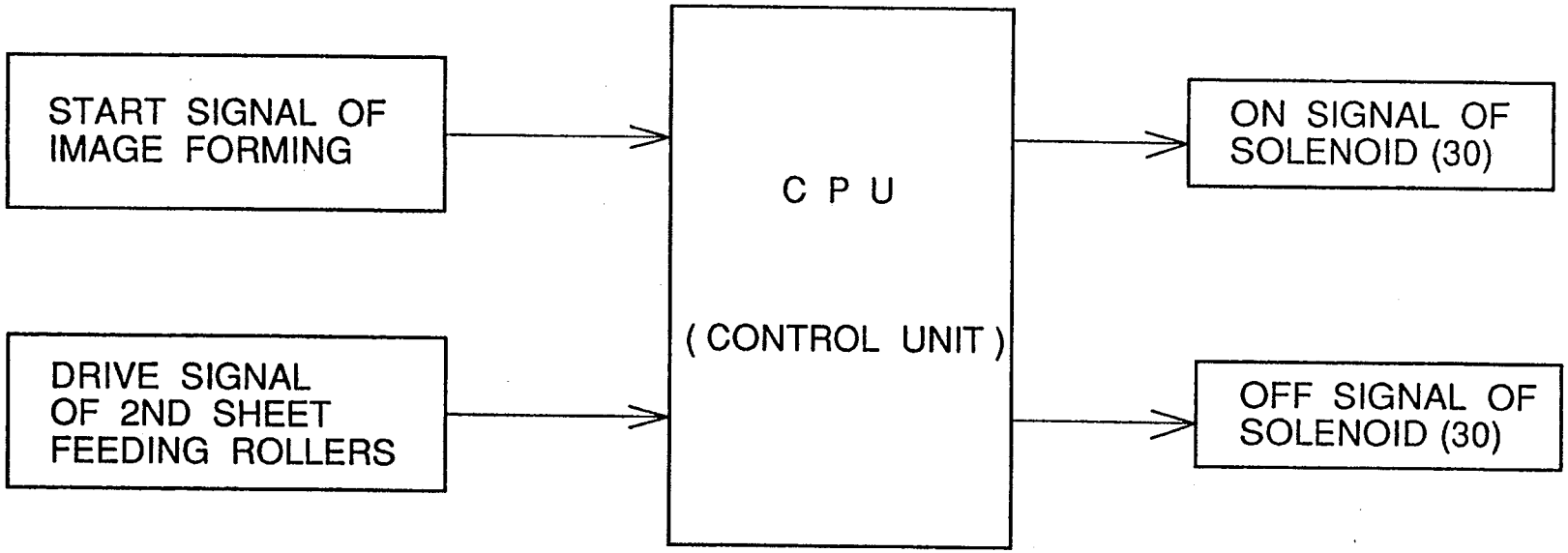
FIG. 4 is a block diagram showing the operations of the charging and transferring units.

As shown in the block diagram of FIG. 4, when a copying operation is started by a command sent from a control panel not shown, the image forming sequence starts. Then, a signal is sent to a solenoid 30 disposed above the transfer unit 12 shown in FIG. 3, through a control section. Accordingly, the solenoid 30 is turned on, and the integrating member 60 holding the transfer unit 12 and charger 6 is pulled upward by the solenoid 30 through an arm 61 engaging with a solenoid plunger 31 while the integrating member 60 resists the force given by the spring 32. Then, the integrating member 60 is moved along engaging grooves (not shown) of a sliding section 62 and a fixed guide 63, so that the charger 6 is raised to a position in which the charger 6 faces the right side curved portion of the photoreceptor belt 1 while a predetermined gap is formed between the charger 6 and the curved portion of the photoreceptor belt 1.

According to the image forming process, a toner image of a predetermined color is formed on the surface of the photoreceptor belt 1. In order to supply a transfer sheet to the transfer unit at a registration timing, a start signal for the transfer sheet which is held by the second paper feed roller 17, is sent from the control section, and then the solenoid 30 is turned off. After that, the integrating member 60 is slid downward by the tension of the spring 32 through the sliding section 62 and the fixed guide 63, and returns to a position determined by the stopper 6C. Accordingly, the transfer unit 12 and the neutralizing plate 12A are set so that they can carry out the transfer process (transfer and separation).

The present invention is not limited to the aforementioned specific embodiment, and even when the transfer unit 12 and the charger 6 are disposed in reverse order, it is included in the scope of the present invention.

Figure 5:
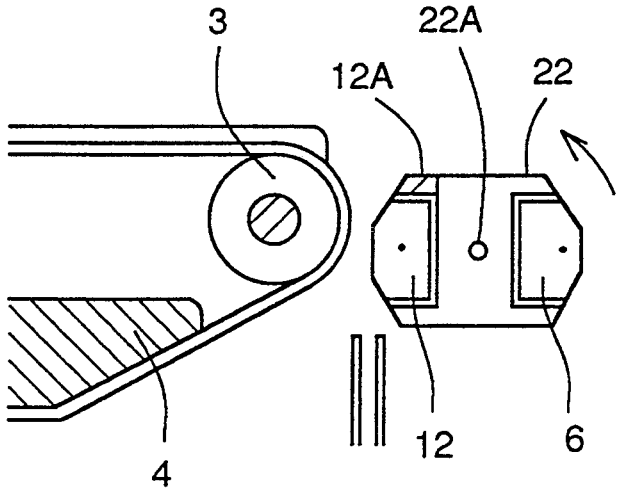
FIG. 5 is a side view showing the structure of the charging and transferring units of another example of the present invention.

Another changeover mechanism is presented as shown in FIG. 5. In the changeover mechanism, the charger 6, transfer unit 12 and neutralizing plate 12A are integrally mounted on a holder 22, and the holder 22 can be rotated around a shaft 22A which is rotatably provided to a frame (not shown) of the color image forming apparatus 25, so that the setting positions of the charger 6, transfer unit 12 and neutralizing plate 12A can be changed over.

Further, another mechanism not shown in the drawing is presented, in which the charger 6 and the transfer unit 12 are incorporated into one unit, and in the case of scorotron charging, for example, electric power, the voltage of which is 4 Kv and the current is 0.25 mA, is outputted, and in the case of transfer, electric power, the voltage of which is 5 Kv and the current is 2 to 3 mA, is outputted. When the mechanism is adopted, the space is further reduced, so that the color image forming apparatus can be made more compact. The cleaning unit 13 faces a left side curved portion of the photoreceptor belt 1 around the rotating roller 2, wherein a predetermined gap is formed between the cleaning unit 13 and the surface of the photoreceptor belt 1. A waste toner box 13C is provided under the cleaning unit 13.

The cleaning unit 13 and the waste toner box 13C are incorporated into a cartridge shown by a chain line, together with the developing units 8, 9, 10, 11 and the photoreceptor belt 1, so that the cartridge is detachably provided to the color image forming apparatus.

At least the photoreceptor belt 1 and the cleaning unit 13 and/or the waste toner box 13C may be incorporated into a cartridge, and the developing units 8, 9, 10, 11 may be incorporated into another cartridge, and the two cartridges may be respectively provided to the image forming apparatus 25.

Consequently, the charger 6, transfer unit 12, neutralizing plate 12A and cleaning unit 13 are separately disposed on both sides of the photoreceptor belt 1 in the longitudinal direction, and the outer circumferential surface of the cartridge is in a closed state. Therefore, even when toner is scattered from the cleaning unit, it scarcely spreads inside the color image forming apparatus. Accordingly, even when the color image forming apparatus is operated over a long period of time, the charger 6, the transfer unit 12 and the optical systems 7A, 7B, 7C and 7E of the laser writing system unit are not stained with toner, and stable color images can be formed.

Figure 7:
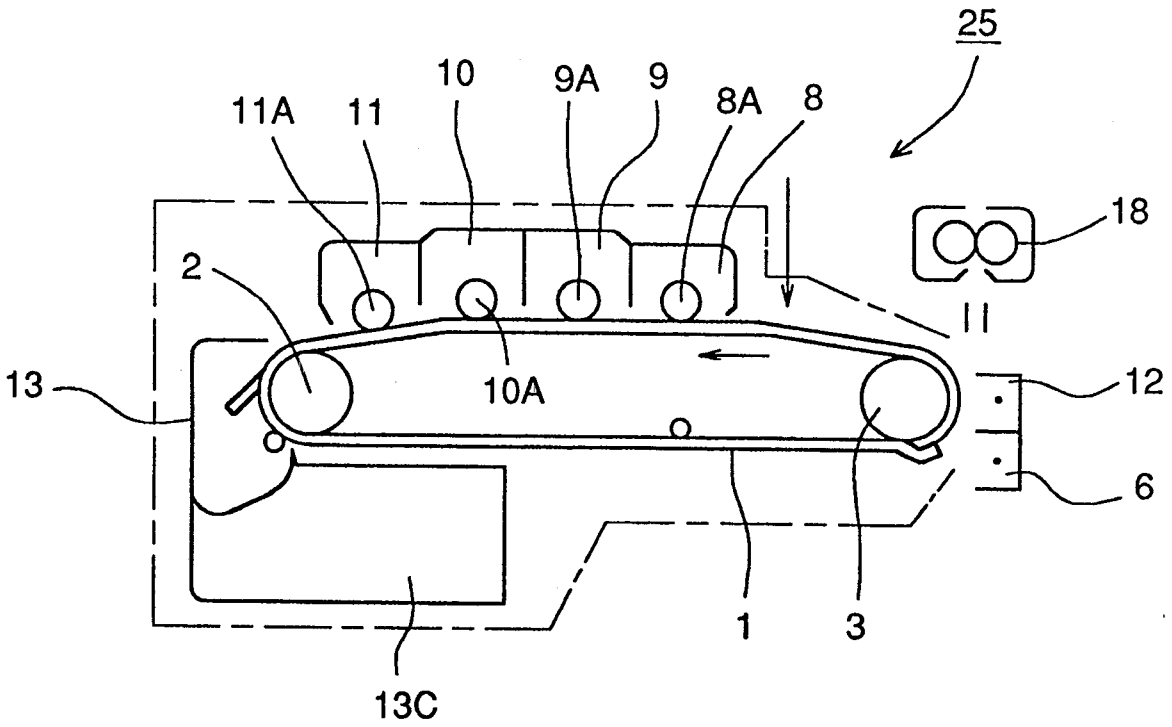
FIG. 7 is a sectional side view showing the structure of a color image forming apparatus of the first example of the present invention in which the developing units are disposed above the photoreceptor belt.

As explained above, the color image forming apparatus of the present invention is structured in this manner: the charger 6 and the transfer unit 12 are incorporated into one unit so that the unit can be used for both a charger and a transfer unit; or the charger 6 and the transfer unit 12 are integrally combined so that the setting positions of the charger 6 and the transfer unit 12 can be changed over. Therefore, the color image forming apparatus 25 can be made compact. In the example, the developing units 8, 9, 10, 11 are disposed below the photoreceptor belt 1 of the color image forming apparatus 25. Next, an example will be explained as follows, in which the developing units 8, 9, 10, 11 are disposed above the photoreceptor belt 1 as shown in FIG. 7.

Above the photoreceptor belt 1 provided between the rotating rollers 2 and 3, the developing units 8, 9, 10, 11 loaded with yellow, magenta, cyan and black toners are disposed at regular intervals from the right to the left in order. The function of these developing units is the same as those disposed below the photoreceptor belt 1.

The cleaning unit 13 is disposed adjacent to the developing unit 11 which is located in the left end, and faces a left side curved portion of the photoreceptor belt 1 around the rotating roller 2, wherein a predetermined gap is formed between the cleaning unit 13 and the surface of the photoreceptor belt 1. A waste toner box 13C is provided under the cleaning unit 13.

On the other hand, the charger 6, transfer unit 12 and neutralizing plate 12A are composed in the same manner as in the aforementioned case. These units are disposed on the opposite side of the cleaning unit 13, and face a curved surface of the photoreceptor belt 1 while a predetermined gap is formed between the units and the surface of the photoreceptor belt 1. The photoreceptor belt 1, cleaning unit 13 and developing units 8, 9, 10, 11 are incorporated into a cartridge shown by a chain line in the drawing, and the cartridge is detachably provided to the image forming apparatus 25.

In the same manner as the aforementioned case, the cartridge of the developing units 8, 9, 10, 11 may be provided independently from the cartridge of the photoreceptor belt 1, cleaning unit 13 and waste toner box 13C. The laser writing system unit 7, the paper feed and conveyance system including the paper feed cassette 14, the paper feed guide 15, the paper feed roller 16 and the timing roller 17, and the paper discharge roller 19 are disposed almost in the same manner as in the aforementioned case, and the function is also the same.

In the same manner as the aforementioned example in which the developing units 8, 9, 10, 11 are disposed below the photoreceptor belt 1, in this color image forming apparatus 25 in which the developing units are disposed above the photoreceptor belt 1, the cleaning unit 13 is disposed adjacent to the developing unit 11, and sufficiently separated from the charger 6, transfer unit 12 and neutralizing plate **12*a*, so that the charger 6 and transfer unit 12** can be prevented from being stained with toner.

Image forming processes such as charging, exposure, development, transfer and cleaning to be conducted in synchronization with the rotation of the photoreceptor belt 1, are carried out in the same manner as in the case in which the developing units 8, 9, 10, 11 are disposed downward. In the same manner as shown in FIG. 6, the photoreceptor belt 1 is rotated by 5 revolutions when a color image is formed. When a monochromatic image is formed, the photoreceptor belt 1 is rotated by 2 revolutions in the same manner as shown by a dotted line in FIG. 6. Therefore, in this case, the same effect as that in the aforementioned example can be provided, and toner can be supplied very easily to the developing units 8, 9, 10, 11 because they are disposed above the photoreceptor belt 1.

At least the photoreceptor belt 1, cleaning unit 13 and waste toner box 13C can be incorporated into a cartridge, as shown by a chain line in the same manner as in the aforementioned example, so that scattering of toner into the color image forming apparatus 25 can be prevented. Therefore, the optical systems 7A, 7B, 7C, 7D of the laser writing system unit 7 can be maintained clean.

In the color image forming apparatus of the present invention, the cleaning unit and waste toner box, and the charger and transfer unit, are separate from each other, and further, the photoreceptor belt, cleaning unit and developing units are incorporated into a cartridge. Accordingly, scattering of toner inside the image forming apparatus can be effectively prevented, so that the charger, transfer unit and optical systems in the laser writing unit are not stained with toner.

In the image forming apparatus of the present invention, the charger and the transfer unit are incorporated into one unit which can be used for both a charger and a transfer unit, or the charger and the transfer unit are combined. Accordingly, the image forming apparatus can be made compact.

What is claimed is:

1. A color image forming apparatus in which a belt-shaped photoreceptor is stretched around rollers to be advanced in a direction of travel, one stretched portion of said photoreceptor being disposed to face a plurality of developing means, and another stretched portion of said photoreceptor, oriented in parallel to said one stretched portion, being disposed to face exposure means, said apparatus comprising:

(a) means for charging said photoreceptor; and (b) means for transferring a toner image from said photoreceptor onto a recording sheet, said charging means and said transferring means being located downstream in said direction of travel from said plurality of developing means; and (c) cleaning means for removing residual toner from said photoreceptor, said cleaning means being provided adjacent to said plurality of developing means, wherein said charging means and said transferring means are incorporated in a single unit, the charging and transfer functions of said charging means and said transfer means being interchangeable, and wherein said single unit is either slidable or rotatable between a first position where said charging operation is conducted and a second position where said transfer operation is conducted.

2. A color image forming apparatus in which a belt-shaped photoreceptor is stretched around rollers to be advanced in a direction of travel, one stretched portion of said photoreceptor being disposed to face a plurality of developing means, and another stretched portion of said photoreceptor, oriented in parallel to said one stretched portion, being disposed to face exposure means, said apparatus comprising:

(a) means for charging said photoreceptor; and (b) means for transferring a toner image from said photoreceptor onto a recording sheet, said charging means and said transferring means being located downstream in said direction of travel from said plurality of developing means; and (c) cleaning means for removing residual toner from said photoreceptor, said cleaning means being provided adjacent to said plurality of developing means, wherein said charging means and said transferring means are incorporated in a single unit movable between a first position for conducting a charging operation and a second position for conducting a transfer operation, said photoreceptor, said plurality of developing means and said cleaning means being integrally formed as a cartridge detachably mountable to said apparatus, and wherein said photoreceptor is advanced through at least five revolutions when a color image is formed by the processes of charging, exposing, developing, transferring and cleaning, and through at least two revolutions when a monochromatic image is formed by said processes.

3. The apparatus of claim 2, wherein said charging and transfer functions are carried out by changing supplied voltage.

4. The apparatus of claim 2, wherein said single unit is either slidable or rotatable between a first position where said charging operation is conducted and a second position where said transfer operation is conducted.

* * * * *